US007786393B2

(12) United States Patent
Isberg et al.

(10) Patent No.: US 7,786,393 B2
(45) **Date of Patent: *Aug. 31, 2010**

(54) COATING OF $M_{n+1}AX_n$ MATERIAL FOR ELECTRICAL CONTACT ELEMENTS

(75) Inventors: Peter Isberg, Västerås (SE); Per Eklund, Linköping (SE); Jens Emmerlich, Linköping (SE); Lars Hultman, Linköping (SE); Hans Högberg, Linköping (SE); Henrik Ljungcrantz, Linköping (SE)

(73) Assignees: ABB Research Ltd., Zurich (CH); Impact Coatings AB, Linkoping (SE)

( * ) Notice: Subject to any disclaimer, the term of this patent is extended or adjusted under 35 U.S.C. 154(b) by 484 days.

This patent is subject to a terminal disclaimer.

(21) Appl. No.: 10/576,183

(22) PCT Filed: Oct. 18, 2004

(86) PCT No.: PCT/IB2004/003390

§ 371 (c)(1),
(2), (4) Date: Dec. 22, 2006

(87) PCT Pub. No.: WO2005/038985

PCT Pub. Date: Apr. 28, 2005

(65) Prior Publication Data

US 2007/0111031 A1 May 17, 2007

Related U.S. Application Data

(60) Provisional application No. 60/511,424, filed on Oct. 16, 2003, provisional application No. 60/511,430, filed on Oct. 16, 2003.

(51) Int. Cl.
*H01H 1/02* (2006.01)

(52) U.S. Cl. ..... 200/262; 428/698; 427/58

(58) Field of Classification Search ..... 428/698; 200/262

See application file for complete search history.

(56) References Cited

U.S. PATENT DOCUMENTS 6,747,291 B1 * 6/2004 Lu et al. ..... 257/77

(Continued)

FOREIGN PATENT DOCUMENTS

WO WO 03/046247 A1 6/2003

OTHER PUBLICATIONS

Michael W. Barsoum, The $M_{N+1}AX_N$ Phases: A New Class of Solids; Thermodynamically Stable Nanolaminates, Prog Solid St Chem, vol. 28, pp. 201-281, 2000.

(Continued)

*Primary Examiner*—Shamim Ahmed
(74) *Attorney, Agent, or Firm*—Venable LLP; Eric J. Franklin

(57) ABSTRACT

An element for making an electric contact to a contact member for enabling an electric current to flow between the element and the contact member. The element includes a body having at least a contact surface thereof coated with a contact layer applied against the contact member. The contact layer includes a film including a multielement material with equal or similar composition as any of a layered carbide or nitride that can be described as $M_{n+1}AX_n$, where M is a transition metal or a combination of a transition metals, n is 1, 2, 3 or higher, A is an group A element or a combination of a group A element, element and X is Carbon, Nitrogen or both.

35 Claims, 6 Drawing Sheets

U.S. PATENT DOCUMENTS

| | | | | |
|---|---|---|---|---|
| 6,838,627 | B1 * | 1/2005 | Isberg et al. | 200/262 |
| 2002/0000598 | A1 | 1/2002 | Kang et al. | |
| 2002/0068488 | A1 * | 6/2002 | Tuller et al. | 439/775 |

OTHER PUBLICATIONS

Palmquist et al., Magnetron sputtered epitaxial single-phase $Ti_3SiC_2$ thin films, Applied Physics Letters, vol. 81, No. 5, Jul. 29, 2002.

Seppänen et al., Structural Characterization of Epitaxial $Ti_3SiC_2$ Films, Proceedings of the 53rd Annual Meeting of the Scandinavian Society for Electron Microscopy, Tampere, Finland, Jun. 12-15, 2002.

* cited by examiner

COATING OF $M_{n+1}AX_n$ MATERIAL FOR ELECTRICAL CONTACT ELEMENTS

CROSS-REFERENCE TO RELATED APPLICATIONS

This application claims priority to U.S. provisional patent applications 60/511,424 and 60/511,430 filed 16 Oct. 2003 and is the national phase under 35 U.S.C. §371 of PCT/IB2004/003390 filed 18 Oct. 2004.

TECHNICAL FIELD

An element for making an electric contact to a contact member for enabling an electric current to flow between said element and said contact member. The element comprising a body having at least a contact surface thereof coated with a contact layer to be applied against said contact member. The contact layer comprises a continuous or discontinuous film comprising a multielement material.

BACKGROUND ART

Recent studies has shown that compounds having the general formula $M_{n+1}AX_n$ exhibit unusual and exceptional mechanical properties as well as advantageous electrical thermal and chemical properties. Despite having high stiffness these compounds are readily machinable, resistant to thermal shock, unusually damage tolerant, have low density and are thermodynamically stable at high temperatures (up to 2300° C. in vacuum). M is a transition metal or a combination of transition metals, n is 1, 2, 3 or higher, A is a group A element or a combination of a group A element, and X is Carbon, Nitrogen or both. Group A element is any of a list: Aluminium Al, Silicon Si, Phosphor P, Sulfur S, Gallium Ga, Germanium Ge, Arsenic As, Cadmium Cd, Indium I, Tin Sn, Thallium Tl, Lead Pb. Transition metal M is any of a list: Scandium Sc, Titanium Ti, Vanadium V, Chromium Cr, Zirconium Zr, Niobium Nb, Molybdenum Mo, Hafnium Hf, Tantalum Ta. $M_{n+1}AX_n$ compounds have layered and hexagonal structures with $M_{n+1}X_n$ layers interleaved with layers of pure A and this is an anisotropic structure which has exceptionally strong M-X bonds together with weaker M-A bonds, which gives rise to their unusual combination of properties.

$M_{n+1}AX_n$ compounds are characterized according to the number of transition metal layers separating the A-group element layers: in 211 compounds there are two such transition metal layers, on 312 compounds there are three and on 413 compounds there ore four. 211 compounds are the most predominant, these comprise $Ti_2AlC$, $Ti_2AlN$, $Hf_2PbC$, $Nb_2AlC$, $(NB,Ti)_2AlC$, $Ti_2AlN_{0.5}C_{0.5}$, $Ti_2GeC$, $Zr_2SnC$, $Ta_2GaC$, $Hf_2SnC$, $Ti_2SnC$, $Nb_2SnC$, $Zr_2PbC$ and $Ti_2PbC$. The only known 312 compounds are $Ti_3AlC_2$, $Ti_3GeC_2$ and $Ti_3SiC_2$. $Ti_4AlN_3$ and $Ti_4SiC_3$ are the only 413 compounds known to exist at present. A large number of solid solution permutations and combinations are also conceivable as it is possible to form solid solutions on the M-sites, the A-sites and the X-sites of these different phases.

The $M_{n+1}AX_n$ compounds can be in ternary, quaternary or higher phases. Ternary phases has three elements, i.e. $Ti_3SiC_2$, quaternary phases has four elements i.e. $Ti_2AlN_{0.5}C_{0.5}$, and so on. Thermally, elastically, chemically and electrically the ternary phases, quaternary phases or higher phases share many of the attributes of the binary phases.

Michel Barsoum has synthesized, characterized and published data on the $M_{n+1}AX_n$ phases named above in bulk form

["The $M_{n+1}AX_n$ Phases: A New class of Solids", Progressive Solid State Chemistry, Vol. 28 pp 201-281, 2000]. His measurements on $Ti_3SiC_2$ show that it has a significantly higher thermal conductivity and a much lower electrical resistivity than titanium and, like other $M_{n+1}AX_n$ phases, it has ability to contain and confine damage to small areas thus preventing/limiting crack propagation through the material. Its layered structure and the fact that bonding between the layers is weaker than along the layers (as in graphite) give rise to a very low friction coefficient, even after six months exposure to atmosphere.

The research groups of Prof. Lars Hultman at Linköping University and Prof. Ulf Jansson at Uppsala University have demonstrated that magnetron sputtering process (a sort of Physical Vapor Deposition, PVD) can be used to deposit coatings of $Ti_3SiC_2$ and other $M_{n+1}AX_n$ phases onto various substrates at relatively low temperatures (approximately 750-1000° C.) [Palmquist, J.-P., et al., "Magnetron sputtered epitaxial single-phase $Ti_3SiC_2$ thin films". Applied Physics Letters, 2002. 81: p. 835; Seppänen, T., et al. "Structural characterization of epitaxial Ti3SiC2 FILM", in Proc. 53rd Annual Meeting of the Scandinavian Society for Electron Microscopy, Tampere, Finland 12-15 Jun., 2002 (Ed. J. Keränen and K. Sillanpää, University of Tampere, Finland, ISSN 1455-4518, 2002), p. 142-143.]

A contact element in an electrical contact arrangement may have many different applications. The contact element is used for making an electric contact to a contact member for enabling an electric current to flow between said element and said contact member. The contact element comprises a body having at least a contact surface thereof coated with a contact layer to be applied against said contact member. A sliding electric contact arrangement comprising two contact surfaces adapted to be applied to each other for establishing an electric contact may slide with respect to each other when establishing and/or interrupting and/or maintaining the contact action. Such electric contact elements, which may establish sliding contacts or stationary contacts has preferably a body made of for instance copper or aluminum.

The contact layer is arranged for establishing a contact to the contact member with desired properties, such as a low contact resistance and low friction coefficient with respect to the material of the contact member to be contacted etc. Such applications are for instance for making contacts to semiconductor devices for establishing and interrupting electric contact, in mechanical disconnections and breakers and for establishing and interrupting electric contacts in contact arrangements of plug-in type. Such electric contact elements, which may establish sliding contacts or stationary contacts has preferably a body made of for instance copper or aluminium.

An example of a contact element including a contact layer, such as a continuous film of a multielement material having strong bonds, such as covalent or metallic bonds, within each atomic layer and weaker bonds, through longer bonding distance or for example as van der Waals bonds or hydrogen bonds, between at least some adjacent atomic layers thereof is given in WO01/41167. The multielement material is $MoS_2$, $WS_2$ or of any layered ternary carbides and layered nitrides that can be described as $M_3AX_2$. A problem with the described multielement material is that methods to produce the material are carried out at high temperatures (700-1400° C.). This means that an electrical electric contact element, which has a body made of a material that is not shape resistant at high temperatures, for instance copper or aluminum cannot be made use of.

SUMMARY OF THE INVENTION

The object of the present invention is to provide an electric contact element having a contact layer with a low friction without the disadvantages mentioned above of such layers already known in connection with use and/or manufacture thereof.

This object is obtained by providing an element for making an electric contact to a contact member for enabling an electric current to flow between said element and said contact member, said element comprising a body having at least a contact surface thereof coated with a contact layer applied against said contact member, and that said contact layer comprises a film comprising a multielement material comprising a nanocomposite of M-X, M-A-X nanocrystals and amorphous regions with M, A, X elements in one or several phases, such as M-A, A-X, M-A-X, or X. The multielement material comprises material with equal or similar composition as at least one of a carbide and nitride that can be described as $M_{n+1}AX_n$, where M is a transition metal or a combination of a transition metals, n is 1, 2, 3 or higher, A is an group A element or a combination of a group A element, and X is Carbon, Nitrogen or both. The multielement material also comprise at least one nanocomposite comprising single elements, binary phases, ternary phases, quaternary phases or higher order phases based on the atomic elements in the corresponding $M_{n+1}AX_n$ compound.

A nanocomposite is a composite comprising crystals, regions or structures with a characteristic length scale above 0.1 nm and below 1000 nm.

According to a preferred embodiment of the invention the $M_{n+1}AX_n$ compound is a layered carbide or layered nitride.

A preferred $M_{n+1}AX_n$ phase is $Ti_3SiC_2$, where the resulting film deposited at low temperature is a nanocomposite of TiC nanocrystals and an amorphous phase with Si—C, Ti—Si—C, Ti—Si and C. This film posses good mechanical, chemical, temperature and contact properties.

It has been found that low temperature deposition of the multielement laminated structure results in nanocomposite compounds, with single elements, binary phases and ternary phases or a higher order phase depending of the number of atomic elements, with good chemical and contact properties. The composition of the compounds on an average should be equal or similar to the composition of the $M_{n+1}AX_n$ phases, such as A-X, M-A-X and X phases. The nanocomposite compounds shows also the desired ductile behaviour, posses non welding properties, shock resistance, chemical inertness, low contact resistance and good high temperatures properties which are all desired properties in electrical contact arrangement. Single phase crystalline microstructure forms large grains structure forms grains from 700° C.

In an embodiment of the invention the multielement material is equal or similar to any of a layered carbide and nitride that can be described as $M_{n+1}AX_n$. The multielement material is in an amorphous state or nanocrystalline (0.5-500 nm grain size) state. The $M_{n+1}AX_n$ compound has a composition $M_xA_yX_x$ where $\{0 \leqq x, y, z \leqq 1; x+y+z=1\}$ or both.

$Ti_xSi_yC_z$ with x=0.5 and 0.1<y<0.3 made by magnetron sputtering onto substrates kept at low temperature, $T_s \leqq 700°$ C., exhibit contact resistance against Ag of 6 μohm at a force of 800 N, which is comparable with Ag—Ag contacts. At the same time many useful mechanical properties are comparable in terms of friction, wear, and hardness to the previously known binary metal containing any metal Me and diamond-like carbon compound C, Me-C.

Unlike the diamond-like carbon compound that is designed for high hardness and thus typically exhibit brittle fracture, the material comprising compounds with equal or similar composition as any of carbide and nitride that can be described as $M_{n+1}AX_n$ and nanocomposites are ductile as seen by wear, scraping, scratching and indenting tests.

The A group element to M-X compounds improves the afore mentioned properties. The nanocomposite comprising compounds with equal or similar composition as at least one of a layered carbide and nitride that can be described as $M_{n+1}AX_n$, such as M-X, M-A-X nanocrystals and amorphous regions with M, A, X elements in one or several phases, such as M-A, A-X, M-A-X, X. The nanocomposites have metallic or ceramic or mixed character type depending on the composition and processing of the film.

The deposited coatings comprising nanocomposites may form a transfer layer of nanolaminated crystalline $M_{n+1}$ $AX_n$ phases or carbon graphite during mechanical wear of an electrical contact. The phase transformation is driven by the thermo-mechanical energy generated in the contact zone. This layer may exhibit ultralow friction due to easy basal plane slip if the $M_{n+1}AX_n$ phase or graphite phase becomes textured parallel to the coating surface. Thus, the coating would not only be functional, but also self-adapting for the application.

PVD, CVD and other deposition processes involving co-deposition of elemental, precursor or compound sources which can be used to make thin films consisting of multielement material equal or similar to $M_{n+1}AX_n$ compound, said multielement material comprising a nanocomposite of M-X or M-A-X nanocrystals and amorphous regions with M, A, X elements in one or several phases, such as M-A, A-X, M-A-X, X. Preferably the depositions are made at low substrate temperatures such as in the demonstrated example. Finally, we note the possibility to design a coating with the widest possible range of properties compared to other materials as function of composition x, y, z and to make gradient material in one deposition run by varying the compositions from different sources.

It has turned out that a nanocomposite comprising said multielement material, and/or a metallic layer is excellent as a contact layer on a contact element in question for many reasons. A contact layer comprising such a multielement material, and/or a metallic layer according to the invention used as a contact has low contact resistance. The friction coefficient thereof is typically 0.1-0.6. The metallic layer provides the low contact resistance. Furthermore, in regions where the contact has a high friction said metallic layer can be worn and the said underlying multielement material comprising a nanocomposite of M-X, M-A-X nanocrystals and amorphous regions with M, A, X elements in one or several phases, such as M-A, A-X, M-A-X, X appears on the surface and reduces the friction.

According to another preferred embodiment of the invention the thickness of the metallic layer is in the range 1 nm to 1000 μm.

According to another preferred embodiment of the thickness of the metallic layer is in the range of a fraction of an atomic layer to 5 μm. This reduce the use of metal without effect the wear properties and friction properties.

According to another preferred embodiment of the invention said metallic layer is any of Au, Ag, Pd, Pt, and Rh. This is an advantage because the noble metals do not form oxides or thermal instable oxides. This is an advantage when used as coatings in high-efficient electrical contacts.

According to another preferred embodiment of the invention said metallic layer is an alloy with at least one of any of the afore mentioned metals.

According to another preferred embodiment of the invention the said metallic layer is any metal or a metal alloy.

According to another preferred embodiment of the invention the said metallic layer is any metal or metal composite where the composite can be an oxide, carbide, nitride or boride. It is an advantage to dope the metal to improve the properties of the layer, for instance the structure of the material.

According to another preferred embodiment of the invention said metallic layer is any metal or metal composite, said composite comprising a polymer, an organic material or a ceramic material such as an oxide, carbide, nitride or boride.

It is an advantage to incorporate a polymer, an organic material or a ceramic material to improve the properties of the layer for instance, According to another preferred embodiment of the invention said the multielement material is coated with a metallic layer sufficiently thick to be able to wire-bond or solder a surface in a bonding to establish a non-separable electrical bond at the surface. The metal film act as a bonding layer by wire-bonding.

Furthermore, said underlying multielement material provides a low friction and wear resistance. Furthermore, said underlying multielement material also is a mechanical load carrying structure with ductile properties under the thin metallic film. The multielement material as low temperature films are showing equal properties compared to films that possesses a layered crystalline structure. The chemical inertness and the smoothness of the multielement compound also contribute to a low friction. The low friction is also due to grain rotation of the nanocomposite phases, and grain boundary phases or carbon. The multielement material are relatively chemical inert and stable at temperatures exceeding 400° C. Furthermore, said materials have low tendency to form oxides, which prevent degradation of electric contact to said contact member. Furthermore said multielement material coated or combined with a metallic layer show a ductile performance.

Said multielement material with equal or similar composition as a $M_{n+1}AX_n$ compound, will have a morphology varying from amorphous or nanocrystalline to pure crystalline, and the morphology may be selected in accordance with the particular use of the contact element and the costs for producing the multielement material.

According to a preferred embodiment of the invention the multielement material of said film coated or combined with a metallic layer is in the range 0.001 μm to 1000 μm, and in a very preferred embodiments is less then 5 μm. Said film of metallic layer is in the range of a fraction of an atomic layer to 1 mm. Such coatings may have a lifetime being nearly indefinite thanks to the very low friction and wear resistance of this material, so that in closed systems the result aimed at will be achieved through a thin film having low costs of material and manufacturing process as a consequence thereof.

According to another a preferred embodiment of the invention the multielement material coated or combined with a metallic layer is above 5 μm. Such a thickness is preferred in the case of using such a film on a contact element in a contact arrangement where the contact element and the contact member are going to be moved with respect to each other, such as in a sliding contact, and accordingly not only moved by different coefficients of thermal expansion upon thermal cycling, such as when used on a slip ring in an electric rotating machine.

According to another preferred embodiment of the invention the nanocomposite multielement film is a blend of different $M_{n+1}AX_n$ compounds where the resulting phases and atomic ratio of the elements are depended on the atomic elements in the $M_{n+1}AX_n$ phases and the ratio between the materials.

According to another preferred embodiment of the invention the body deeper under said contact surface is made of material being non-resistant to corrosion, and the material last mentioned is coated by a corrosion resistant material such as nickel, adapted to receive said film on top thereof. It is preferred to proceed in this way, since the multielement material film may have pores with a risk of corrosion of the underlying body material therethrough.

Another object of the present invention is to provide sliding electric contact arrangement of the type defined in the introduction allowing a movement of two contact surfaces applied against each other while reducing the inconveniences discussed above to a large extent.

This object is according to the invention obtained by providing such an arrangement with a contact element according to the present invention with said film arranged to form a dry contact with a friction coefficient, below 0.6, preferably below 0.2, to a contact member.

In another preferred embodiment of the invention such an arrangement with a contact element according to the present invention is provided with said film arranged to form a dry contact with a friction coefficient below 0.1.

The basic features and advantages of such a contact arrangement are associated with the characteristics of the contact element according to the present invention and appear from the discussion above of such a contact element. However, it is pointed out that a "sliding electric contact" includes all types of arrangements making an electric contact between two members, which may move with respect to each other when the contact is established and/or interrupted and/or when the contact action is maintained. Accordingly, it includes not only contacts sliding along each other by action of an actuating member, but also so called stationary contacts having two contact elements pressed against each other and moving with respect to each other in the contacting state as a consequence of magnetostriction, thermal cycling and materials of the contact elements with different coefficients of thermal expansion or temperature differences between different parts of the contact elements varying over the time.

A contact arrangement of the type last mentioned constitutes a preferred embodiment of the present invention, and the contact elements may for instance be pressed with a high pressure, preferably exceeding 1 MPa against each other without any mechanical securing means, but the contact elements may also be forced against each other by threaded screws or bolts.

According to another preferred embodiment of the invention said contact arrangement is adapted to be arranged in an electric rotating machine, where the film comprising multielement material will result in a number of advantages. It is in particular possible to benefit from the low friction coefficient of the multielement material when arranging the contact element and the contact member of the contact arrangement on parts of the rotating machine moving with respect to each other, such as for instance the slip ring as a contact element and a contact element sliding thereupon. It will in this way be possible to replace the carbon brushes used in the electric rotating machines by a contact element according to the present invention and a film of said type is then also preferably arranged on the moving part, such as a slip ring. Said carbon brushes have a number of disadvantages, such as a restricted lifetime, since the carbon is consumed. Furthermore, carbon dust is spread out on the windings and other parts of the machine, which may disturb the function thereof. It is preferred to have a thickness of the film of multielement material exceeding 10 μm for such a contact element, since also the film of multielement material will be consumed, but comparatively slowly, in this application thereof.

Electrical contacts arrangements according to other preferred embodiments of the invention are different kinds of contacts having contact surfaces moving while bearing against each other in establishing and/or interrupting an electric contact, such as plug-in contacts or different types of spring-loaded contacts, in which it is possible to take advantage of the very low friction coefficient of a multielement material resulting in a self-lubricating dry contact without the problems of lubricants such as oils or fats while making it possible to reduce the operation forces and save power consumed in actuating members.

Electrical contacts arrangements according to other preferred embodiments of the invention are included in tap changers on transformers, where a low friction is a great advantage when the contact elements are sliding with their contact surfaces against each other, and in mechanical disconnectors and breakers and in relays.

The invention also relates to a use of the contact arrangement, in which a probe for measuring and testing an integrated circuit is covered with said multielement material film, a contact layer is coated/combined with a metallic layer, avoiding chemical degradation and metal cladding on the probe. It is self evident that this use according to the invention is very favourable, since it will make it possible to carry out measurements and testing without any interruptions for replacing or cleaning the probe.

The invention also relates to a use of the contact arrangement, in which a contact for enabling contact to an electronic device, such as an integrated circuit is covered with a said multielement material film enabling electrical contact to the device.

Further advantages as well as advantageous features appear from the following description.

BRIEF DESCRIPTION OF THE DRAWINGS

With reference to the appended drawings, below follows a specific description of preferred embodiments of the invention. In the drawings.

DESCRIPTION OF THE PREFERRED EMBODIMENTS

Figure 1A:
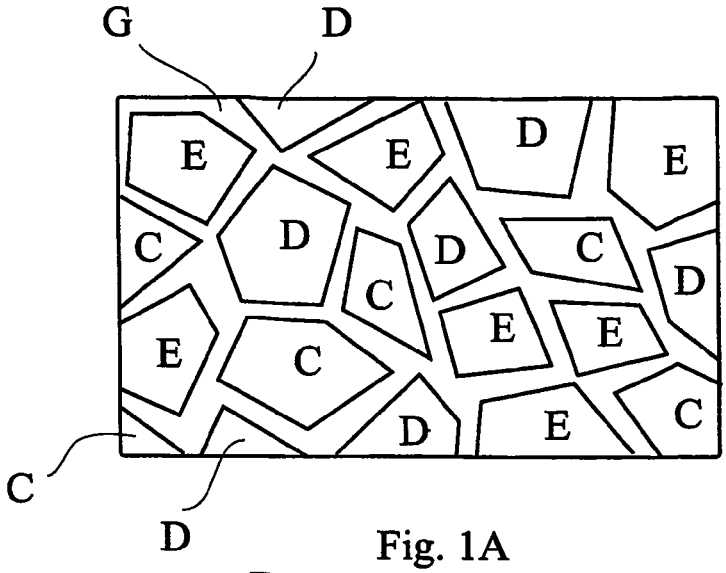
FIG. 1A depicts a structure of a multielement material layer comprising nanocomposites with nanocrystals mixed with amorphous regions.

FIG. 1A depicts a structure of a multielement material layer with equal or similar composition as any of a layered carbide and nitride that can be described as $M_{n+1}AX_n$ where M is a transition metal or a combination of a transition metals, n is 1, 2, 3 or higher, A is an group A element or a combination of a group A element, and X is Carbon, Nitrogen or both, comprising a nanocomposite of M-X, M-A-X nanocrystals and amorphous regions with M, A, X elements in one or several phases, such as M-A, A-X, M-A-X, X. The multielement material has amorphous regions (denoted G in the figure) mixed with regions in of the multielement material in a nanocrystalline state (denoted C, D, E in the figure). The individual regions (denoted C, D and E in the picture) in the structure is a single element, binary phases, ternary phases and/or higher order phases depending on the number of atomic elements in the film.

Figure 1B:
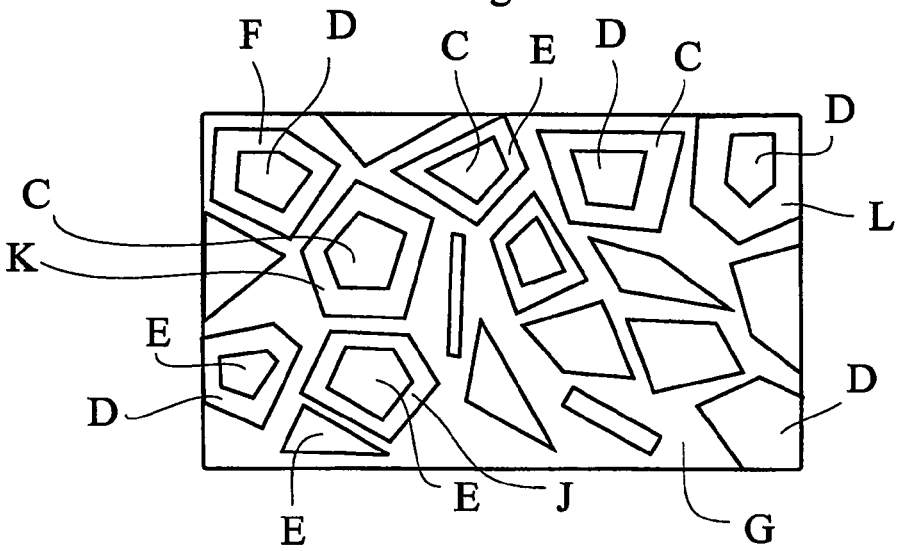
FIG. 1B depicts another structure of a multielement material layer comprising nanocomposites with nanocrystals mixed with amorphous regions.

FIG. 1B depicts a structure of a multielement material with the elements that is described in the description to FIG. 1A. The multielement material has amorphous regions with M-A, A-X, M-A-X and X phases (denoted G in the figure) mixed with regions in of the multielement material in a nanocrystalline state, M-A-X and/or M-X and/or M-X of $M_{n+1}AX_n$ phases of which some is surrounded by an amorphous layer (denoted J, K, L in the figure), or crystalline layer (denoted C, D, E in the figure), of a pure M-A, A-X, M-A-X and X phases material (denoted C, D, E in the figure).

Figure 2:
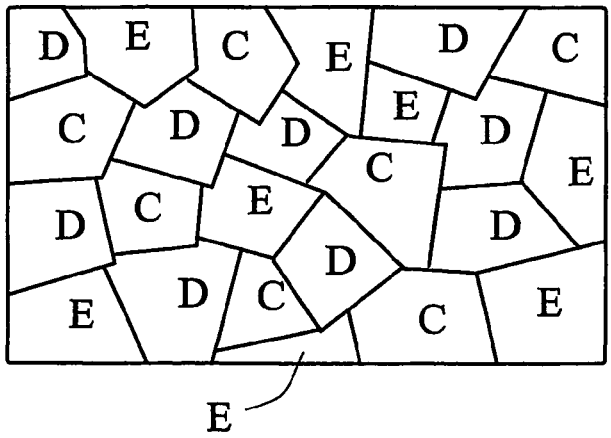
FIG. 2 depicts a structure of a multielement material layer with regions in a nanocrystalline state.

FIG. 2 depicts a structure of a multielement material with the elements that is described in the description to FIG. 1 layer with regions in a nanocrystalline state, (denoted C, D, E in the figure). The individual regions (denoted C, D and E in the picture) in the structure are a single element, binary phases, ternary phases and/or higher order phases.

Figure 3:
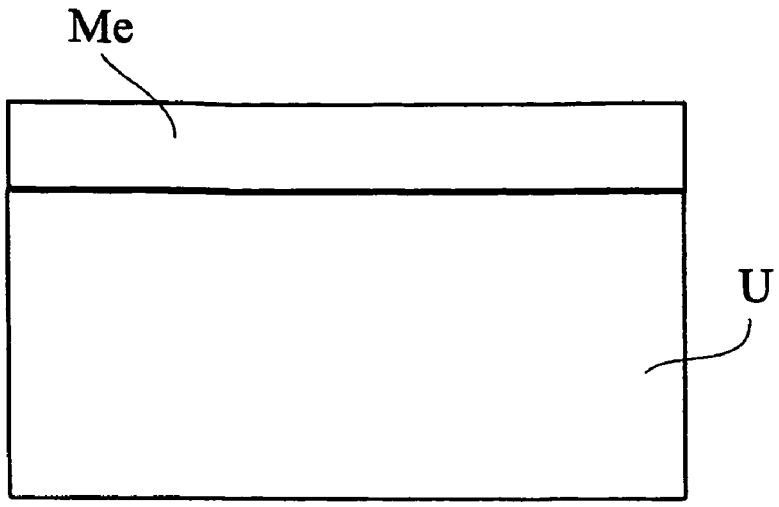
FIG. 3 depicts a structure of a multielement material comprising a metallic layer.

FIG. 3 depicts a structure of a multielement material U with the elements that is described in the description to FIG. 1 comprising a metallic layer Me.

Figure 4:
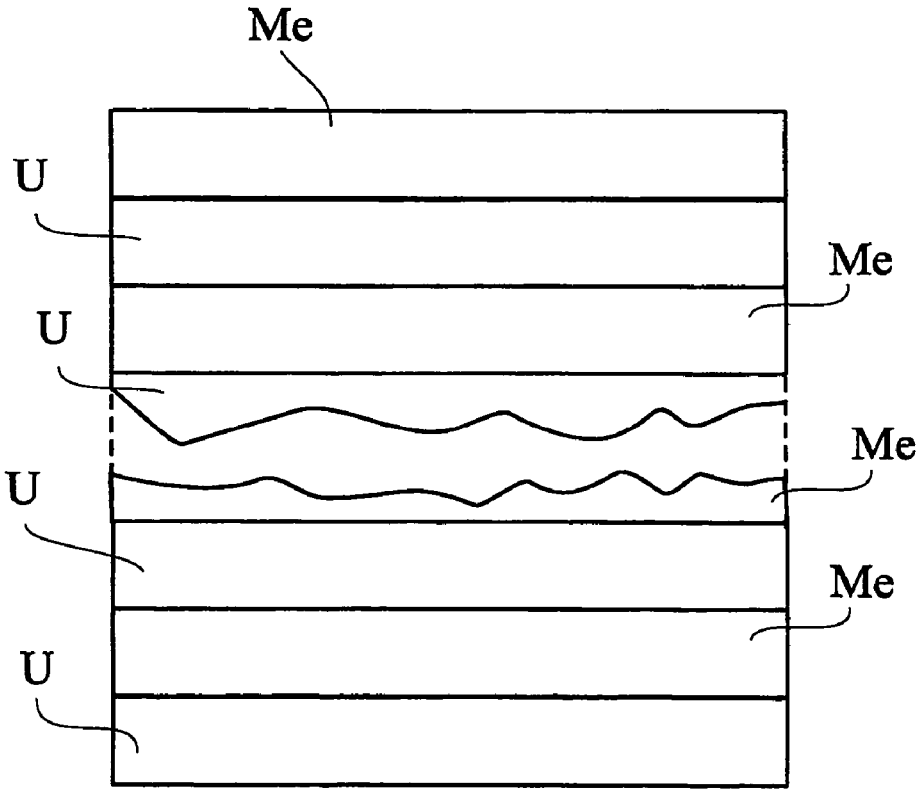
FIG. 4 depicts a structure of a multielement material layer laminated with metallic layers in a repeated structure.

FIG. 4 depicts a structure of multielement material layers with the elements that is described in the description to FIG. 1 layer laminated with metallic layers Me in a repeated structure. The multielement material layers in amorphous regions mixed with regions in a nanocrystalline state (denoted U in the figure).

Figure 13:
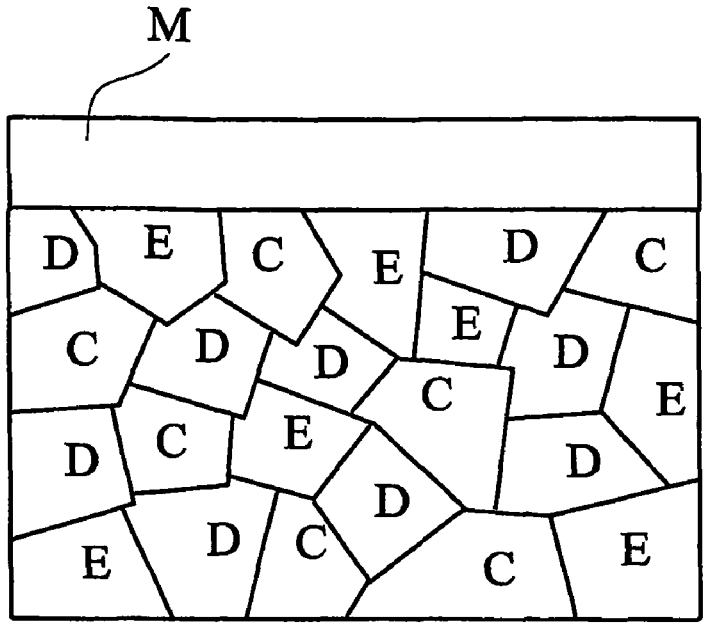
FIG. 13 depicts a structure of a multielement material layer and a metallic layer and FIG. 14 depicts a structure of a multielement material layer laminated with metallic layers in a repeated structure.

FIG. 13 depicts a structure of a multielement material with regions in a nanocrystalline state, (denoted C, D, E in the figure) comprising a metallic layer Me.

Figure 14:
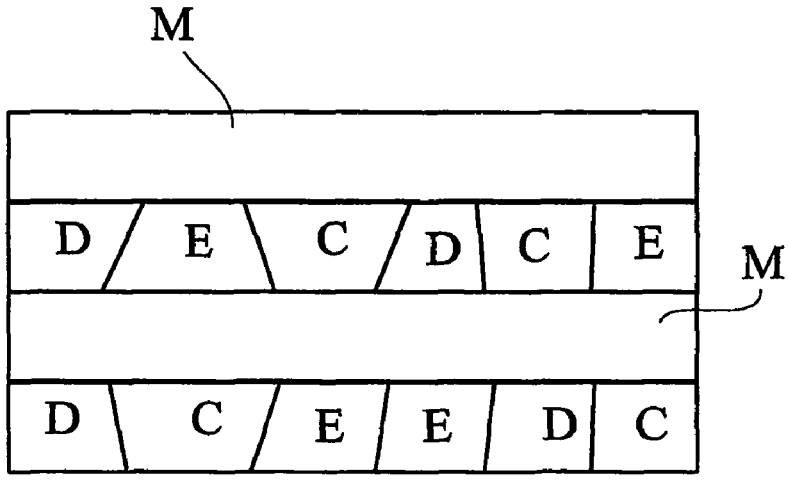

FIG. 14 depicts a structure of multielement material layers with the elements that is described in the description to FIG.

1 layer laminated with metallic layers Me in a repeated structure. The multielement material layers with regions in a nanocrystalline state, (denoted C, D, E in the figure).

In another preferred embodiment of the invention the multielement material may comprise ternary phases and/or higher order phases for example 211, 312, 413 compounds. The multielement material has at least one carbide and/or nitride that can be described as $M_{n+1}AX_n$ component. In order to improve friction, thermal properties, mechanical properties or electrical properties the multielement material may comprise one or a combination of compounds any of a list: a single group A element, a combination of a group A elements, X is Carbon, X is Nitrogen, X is both Carbon and Nitrogen, a nanocomposite of M-X, a nanocomposite of M-A-X, nanocrystals and/or amorphous regions with M, A, X elements in one or several phases, such as M-A, A-X, M-A-X. The proportions of the included compounds may vary within a range of 0.0001-90% of the weight of the film. Different proportions of the compounds will strengthen the mechanical, physical, and chemical properties. In a preferred embodiment of the invention the proportions of the included compounds should not exceed 50% of the weight of the film, and in another preferred embodiment of the invention less then 20%. For instance compounds of Ag exceed the surface conductibility.

Another preferred embodiment according to the invention is a multielement material with excess of the M, A, X element. The multielement material for instance comprise the compound $Ti_{n+1}SiC_n+C_m$. The compound $Ti_{n+1}SiC_n+C_m$ is a multielement material with excess carbon. That means that the film contains free carbon elements. The excess carbon X are transported to the surface and may function as a friction lower surface termination that provides electrical contact and protect the electrical surface from oxidation. The compound $Ti_3SiC_2+C_m$ has a low contact resistance. The material may also have groups of M-A, M-A-X, A-X in various proportions.

In another preferred embodiment according to the invention the multielement material comprises the compound $Ti_3Si_{0.5}Sn_{0.5}C_2$. If the A group element is tin, Sn, the film may be too hydroscopic. If the A group element is silicon, Si, the film may react with oxygen and form a coating of an isolating oxide on the surface. These disadvantages are avoided if a combination of A element, in this case Sn and Si are used.

Figure 5:
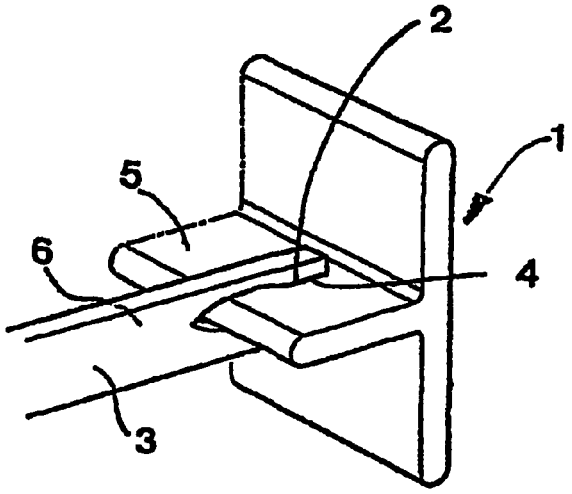
FIG. 5 illustrates an electric contact element of plug-in type according to a preferred embodiment of the invention.

FIG. 5 shows a contact arrangement 1 of plug-in type, in which a contact surface 2 on a contact element 3 slides along and while bearing against contact surfaces 4 on another contact element 5, here called contact member. The contact element 3 has a female character and is present in the form of a resilient jaw adapted to be connected to the male contact member 5 in the form of a contact rail. The contact element 3 is applied on the contact member 5 and bears in the contacting state while being biased by means of at least a contact surface 2 against a contact surface 4 on the contact member 5. At least one of the contact surfaces 2 and 4, preferably both, are provided with a continuous or discontinuous multielement material film according to the invention said film a comprising a multielement material with equal composition as any of a layered carbide and nitride that can be described as $M_{n+1}AX_n$, where M is a transition metal or a combination of a transition metals, n is 1, 2, 3 or higher, A is an group A element or a combination of a group A element, B is an group B element or a combination of a group B element and X is Carbon, Nitrogen or both and the multielement material comprising a nanocomposite of M-X, M-A-X nanocrystals and amorphous regions with M, A, X elements in one or several phases, such as M-A, A-X, M-A-X, or X. This film has in a preferred embodiment of the invention a thickness in the range of 0.001 μm to 1000 μm, and it will have a very low friction coefficient, typically 0.01 to 0.1. This means that the friction forces to be overcome when controlling the contact arrangement for establishing or interrupting the electric contact will be very low, resulting in a low necessary power consumption in an actuating member and a nearly neglectible wear of the of the contact surfaces constituted by this film. Furthermore, the film is chemical inert and stable at temperatures exceeding 400° C. It is pointed out that it is well possible that said continuous or discontinuous film is arranged on only the contact member 5, which of course is a contact element just as the contact element 3. Furthermore, in this case the film comprising multielement material is deposited and adheres to the body 6 of the contact element 3, but in other preferred embodiments of the invention it is well possible that said film coats a body being laid on top thereof as a separate foil. This may in particular be the case for the embodiment shown in FIG. 3 described further below. The continuous or discontinuous film comprising the multielement material may be deposited on the body of the contact element, being preferably of Cu, by different kinds of Physical Vapour Deposition (PVD), Chemical Vapour Deposition (CVD), electrochemically, electroless deposition or with thermal plasma spraying. It is preferred to provide a thin layer of a corrosion resistant material on the body before applying said film would the body be of a material being non-resistant to corrosion, since it is possible that the film will have some pores reaching therethrough.

Figure 6:
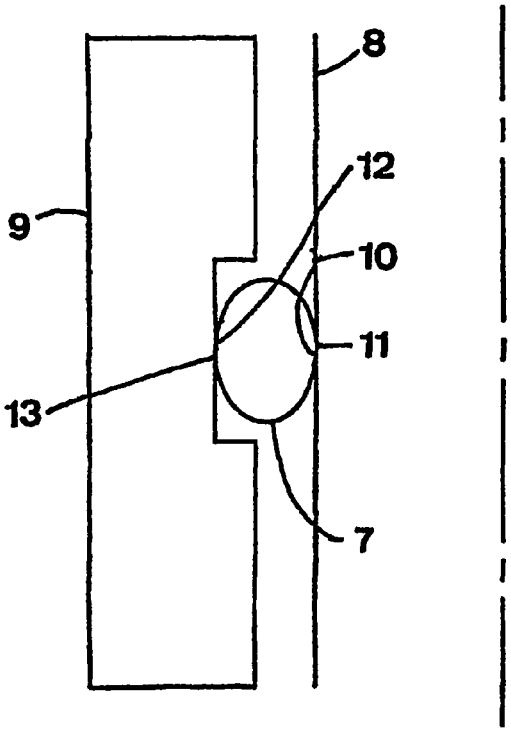
FIG. 6 is a sectioned view of an electric contact element of helical contact type according to another preferred embodiment of the invention.

FIG. 6 illustrates a further example of a contact arrangement in which it is advantageous to coat at least one of the contact surfaces with a continuous or discontinuous film comprising a multielement material, according to the invention said film forming a self lubricating dry contact with a very low friction according to the present invention. This embodiment relates to a helical contact arrangement having a contact element 7 in the form of a spring-loaded annular body such as a ring of a helically wound wire adapted to establish and maintain an electric contact to a fist contact member 8, such as an inner sleeve or a pin, and a second contact member 9, such as an outer sleeve or a tube. The contact element 7 is in contact state compressed so that at least a contact surface 10 thereof will bear spring-loaded against a contact surface 11 of the first contact member 8, and at least anther contact surface 12 of the fist contact element 7 will bear spring-loaded against at least a contact surface 13 of the second contact member 9. According to this preferred embodiment of the invention at least one of a contact surfaces 10-13 is entirely or partially coated with a continuous or discontinuous low friction film comprise the multielement material. Such a helical contact arrangement is used for example in an electrical breaker in a switchgear device.

Figure 7:
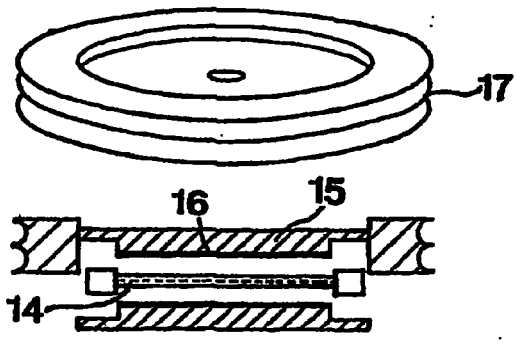
FIG. 7 is a partially sectioned and exploded view of an arrangement for making an electric contact to a power semiconductor device according to a preferred embodiment of the invention.

An arrangement for making a good electric contact to a semiconductor component 14 is illustrated in FIG. 7, but the different members arranged in a stack and pressed together with a high pressure, preferably exceeding 1 MPa and typically 6-8 MPa, are shown spaced apart for clarity. Each half of the stack comprises a pool piece 15 in the form of a Cu plate for making a connection to the semiconductor component. Each pool piece is provided with a thin continuous or discontinuous film 16 comprising multielement material, and a metallic layer. The coefficient of thermal expansion of the semiconductor material, for instance Si, SiC or diamond, of the semiconductor component and of Cu differs a lot ($2.2*10^6$/K for Si and $16*10^{-6}$/K for Cu), which means that the Cu plates 15 and the semiconductor component 14 will move laterally with respect to each other when the temperature thereof changes. Contact arrangements of this type according to the stand of the art require for that sake one or several further members in said stack between the pool piece and the semiconductor component for taking care of this tendency to mutual movements upon thermal cycling for avoiding cracks in the semiconductor component and/or wear of the contact surface of said component. However the very low friction of a film according to the present invention makes it possible to omit all these additional members and making the contact arrangement less costly, not at the least by allowing the issue of a cheap material without any need of thermal matching close to there semiconductor component. A contact arrangement of this type is a part of power electronic encapsulation 17 forming a closed system, and practically no material will be consumed when the film moves along the semiconductor component upon thermal cycling so that the lifetime thereof will be practically indefinite. The multielement contact layer 16 can also be deposited directly on the semiconducting device 14 or both on the Cu pole piece 15 and the device 14.

Figure 8:
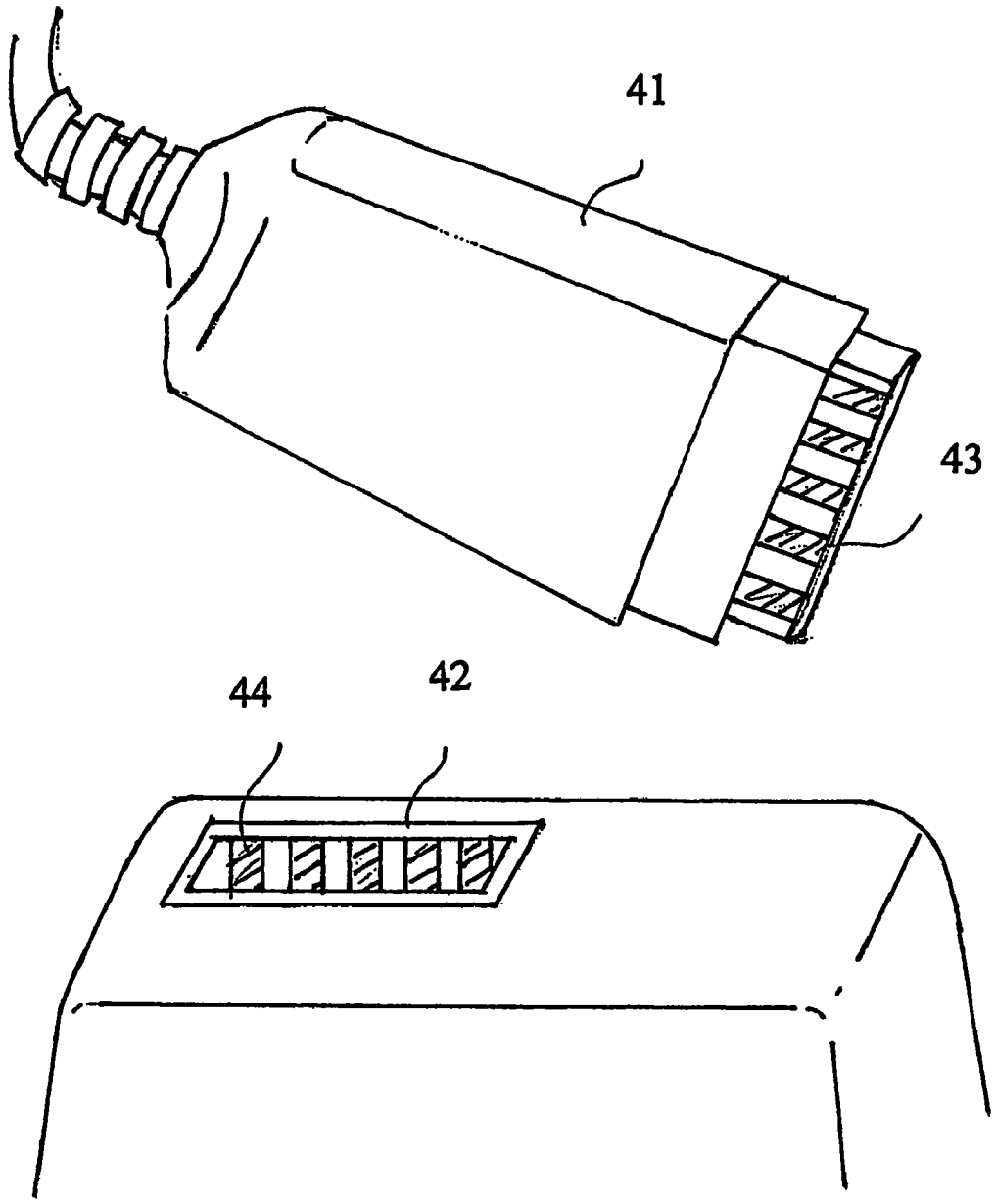
FIG. 8 illustrates schematically a contact arrangement of a contact arrangement according to a preferred embodiment of the invention in electrical equipment.

FIG. 8 illustrates schematically an electric contact arrangement of plug-in type, for example used in electrical equipment. The members are arranged to be pressed together but are shown spaced apart for clarity. The contact arrangement has a first contact member 41, which has male character, and second contact member 42, which has female character. The first contact member 41 is adapted to be connected to the second contact member 42, by means of at least a contact surface 43 on the first contact member against a contact surface 44 on the second contact member. At least one of the contact surfaces 43 and 44, preferably both, are provided with a continuous or discontinuous film comprising the multielement material.

Figure 9:
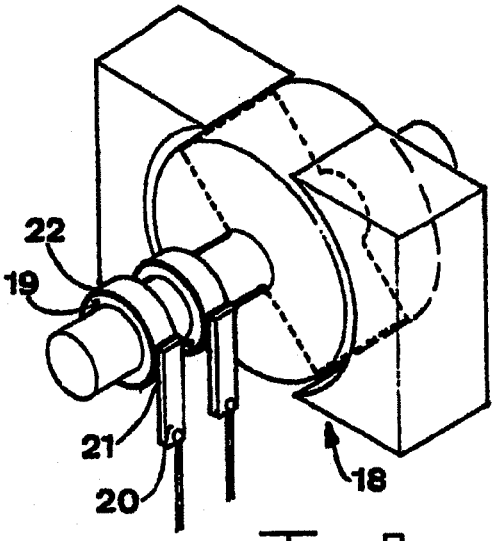
FIG. 9 illustrates very schematically a sliding contact arrangement in an electric rotating machine according to a further embodiment of the invention.

A sliding contact arrangement according to another preferred embodiment of the invention is schematically illustrated in FIG. 9 as used in an electric rotating machine 18 of any type for establishing an electric contact between a slip ring 19 and ac contact element 20, which here replaces a carbon brush and is made of a body for instance copper or aluminium coated with a continuous or discontinuous film indicated at 22. This results in a very low friction electric contact having a low contact resistance. It would also be possible to use a contact arrangement having a continuous or discontinuous film of multielement material between two members moving with respect to each other in an electric rotating machine for avoiding a static electricity to be built up.

Figure 10:
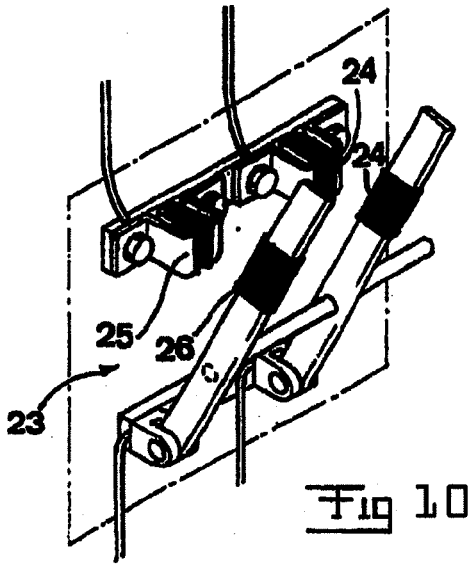
FIG. 10 illustrates very schematically a contact arrangement according to the present invention in a disconnector.

FIG. 10 illustrates very schematically how an electric contact arrangement according to the invention may be arranged in a disconnector 23 with a low friction film 24, comprising a multielement material, and a metallic layer, on at least one of the contact surfaces of two contact elements 25, 26 movable with respect to each other for establishing an electric contact there between and obtaining a visible disconnection of the contact elements.

Figure 11:
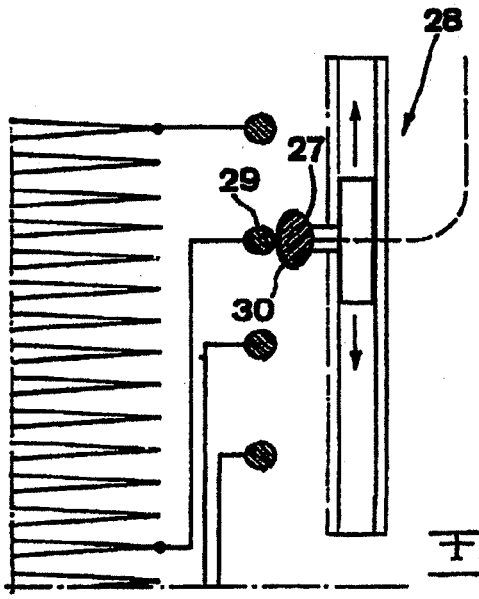
FIG. 11 illustrates very schematically a sliding contact arrangement in a tap changer of a transformer according to a preferred embodiment of the invention.

FIG. 11 illustrates schematically a sliding electric contact arrangement according to another preferred embodiment of the invention, in which the contact element 27 is a movable part of a top changer 28 of a transformer adapted to slide in electric contact along contacts 29 to the secondary contact member, for tapping voltage of a level desired from said transformer. A low friction film 30, comprising a multielement material, and a metallic layer, is arranged on the contact surface of the contact element 27 and/or on the contact member 29. The contact element 27 may in this way be easily moved along the winding 29 while maintaining a low resistance contact thereto.

Figure 12:
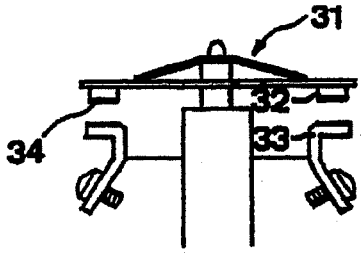
FIG. 12 illustrates very schematically a contact arrangement according to the present invention in a relay.

FIG. 12 illustrates very schematically a contact arrangement according to another preferred embodiment of the invention used in a relay 31, and one or both of the contact surfaces of opposite contact elements 32, 33 may be provided with a low friction film 34 comprising a multielement material, which will result in less wear of the contact surfaces due to lower tendency of welding and make them corrosion resistant as a consequence of the character of multielement material.

A contact element and a sliding electric contact arrangement according to the present invention may find many other preferred applications, and such applications would be apparent to a man with ordinary skill in the art without departing from the basic idea of the invention as defined in the appended claims.

It would for example be possible to dope the thin friction film for improving friction, thermal, mechanical or electrical properties by one or several compounds or elements. However, the amount of doping should not exceed 20% of the weight of the film. It is then also possible to have different films on different contact surfaces of the contact elements and the contact member, for instance some doped and others not or some formed by at least two sub-layers and others having only one layer.

Another example of a contact arrangement according to the invention is to cover a probe for measuring and testing an integrated circuit (IC) with said film, comprising a multielement material and a metal layer, avoiding chemical degradation and metal cladding on the probe.

Furthermore, the contact elements and arrangements of the invention are not restricted to any particular system voltages, but may be used on low, intermediate and high voltage applications.

The multielement material of the contact layer according to the invention may form a solid film together with 50-90% of metal, for instance of Ti or Au, for improving the conductivity. This may take place by forming a homogeneous dispersion of the metal in the material, inhomogeneous dispersion with metallic regions and multielement regions, such as a composite or by arranging a layer of the multielement chemical compound and a layer of the metal alternating.

The invention claimed is:

1. A contact element for making an electrical contact to a contact member for enabling an electric current to flow between said contact element and said contact member, said contact element comprising:

a body having at least a contact surface thereof coated with a contact layer arranged to be applied against said contact member, which contact layer comprises a film comprising a multielement material, wherein said multielement material comprises material with equal composition as at least one of a carbide or nitride that is described as $M_{n+1}AX_n$ where M is a transition metal or a combination of a transition metals, n is 1, 2, 3 or higher, A is a group A element or a combination of a group A element, and X is Carbon, Nitrogen or both, said multielement material also comprises at least one nanocomposite comprising single elements, binary phases, ternary phases, quaternary phases or higher order phases based on atomic elements in the $M_{n+1}AX_n$ compound, wherein said nanocomposite comprises at least one of M-X and M-A-X nanocrystals and at least one amorphous region with M, A, X elements in one or several phases.

2. The contact element according to claim 1, wherein said nanocomposite comprises at least two of the following phases: M-A, A-X, M-A-X, X, M-X, or a combination of said materials.

3. The contact element according to claim 1, wherein the M, A, X elements of the amorphous regions are in at least one phase of M-A, A-X, M-A-X, or X.

4. The contact element according to claim 1, wherein said transition metal is Ti, n is 1, 2, 3 or higher, X is C, and A is at least one of Si, Ge or Sn or a combination of said elements.

5. The contact element according to claim 1, wherein said multielement material is $Ti_3SiC_2$ and the nanocomposite comprise at least one of the following Ti—C, Si—C, Ti—Si—C, Ti—Si, C or a combination of said materials.

6. The contact element according to claim 1, wherein the amorphous region comprises at least one phase of M-A-X, AX, M-A, M-X, X, A, of M.

7. The contact element according to claim 1, wherein said amorphous regions are mixed with said nanocrystals.

8. The contact element according to claim 1, wherein said film comprises individual regions that are single element, binary phases, ternary phases and/or higher order phases of carbide and nitride.

9. The contact element according to claim 1, wherein said multielement material comprises individual regions that are a single element, binary phases, ternary phases and/or higher order phases with an average composition equal to or similar carbide and nitride.

10. The contact element according to claim 1, wherein said film comprises a nanocomposite having a composition comprising a combination of different $M_{n+1}AX_n$ phases.

11. The contact element according to claim 1, wherein the thickness of said film is in the range of a fraction of an atomic layer to 1000 μm.

12. The contact element according to claim 1, wherein the thickness of said film is in the range of 0.0001 μm to 1000 μm.

13. The contact element according to claim 1, wherein the thickness of said film is in the range of a fraction of an atomic layer to 5 μm.

14. The contact element according to claim 1, wherein said film comprises a metallic layer (Me), the thickness of the metallic layer is in the range of a fraction of an atomic layer to 1000 μm.

15. The contact element according to claim 14, wherein the thickness of the metallic layer in the range of a fraction of an atomic layer to 5 μm.

16. The contact element according to claim 14, wherein the thickness of the metallic layer in the range 1 nm to 1000 μm.

17. The contact element according to claim 14, wherein said metallic layer is any of Au, Ag, Pd, Pt, Rh or an alloy with at least one of any of the afore mentioned metals.

18. The contact element according to claim 14, wherein said metallic layer is any metal or a metal alloy.

19. The contact element according to claim 14, wherein said metallic layer is any metal or metal composite where the composite can be an oxide, carbide, nitride or boride.

20. The contact element according to claim 14, wherein said metallic layer is any metal or metal composite, said composite comprising a polymer, an organic material or a ceramic material such as an oxide, carbide, nitride or boride.

21. The contact element according to claim 14, wherein said multielement material layer is laminated with metallic layers in a multilayer structure.

22. The contact element according to claim 14, wherein said multielement material has a coat of said metallic layer, in that the contact surface is metallic.

23. The contact element according to claim 14, wherein the metallic layer covers grains or regions of the multielement material, with the total film thickness is in the range 0.0001 μm to 1000 μm.

24. The contact element according to claim 14, wherein the metallic layer is sufficiently thick to be able to wire-bond or solder a surface in a bonding to establish a non-separable electrical bond at the surface.

25. The contact element according to claim 1, wherein said film is continuous.

26. The contact element according to claim 11, wherein said film is discontinuous.

27. The contact element according to claim 1, wherein said film is deposited on said body and adheres thereto.

28. The contact element according to claim 1, wherein said film is arranged as freestanding foil to be applied against said contact member when making said electric contact.

29. The contact element according to claim 1, wherein said film is doped by one or several compounds or elements for altering and improving friction, mechanical, thermal and electrical properties of said film.

30. The contact element according to claim 1, wherein said film comprises at least one single element M, A, X in the corresponding $M_{n+1}AX_n$ compound within a range of 0-50% by weight.

31. The contact element according to claim 27, wherein said film is formed on said body by means of a chemical method such as an electro less or an electrolytic process.

32. The contact element according to claim 27, wherein said film is deposited on said body by the use of a vapor deposition technique.

33. The contact element according to claim 32, wherein said film is deposited on said body by physical vapor deposition or chemical vapor deposition.

34. The contact element according to claim 27, wherein said film is deposited on said body by dipping the body in a chemical solution or spraying it on said body.

35. The contact element according to claim 27, wherein said film is deposited using at least one technique selected from the following group arranged as freestanding foil to be applied against said contact member when making said electric contact;

doped by one or several compounds or elements for altering and improving friction, mechanical, thermal and electrical properties of said film;

formed on said body by means of a chemical method such as an electro less or an electrolytic process;

deposited on said body by the use of a vapor deposition technique;

deposited on said body by Physical Vapour Deposition or Chemical Vapour Deposition; and deposited on said body by dipping the body in a chemical solution or spraying it on said body through for example thermal or plasma spraying.

* * * * *